United States Patent [19]

Lu

[11] Patent Number: 4,934,539

[45] Date of Patent: Jun. 19, 1990

[54] KNIFE STAND

[76] Inventor: Keh J. Lu, No. 16, Ching Mei Road, Taiping Hsiang, Taichung, Taiwan

[21] Appl. No.: 142,646

[22] Filed: Jan. 11, 1988

[51] Int. Cl.[5] ..... A47F 1/04

[52] U.S. Cl. ..... 211/70.7; 248/37.3; D7/637

[58] Field of Search ..... 248/37.3, 37.6, 152, 248/312, 312.1; D7/73, 74; 211/70.6, 70.7; 206/553; 30/296 R, 296 A

[56] References Cited

U.S. PATENT DOCUMENTS

| | | | |
|---|---|---|---|
| D. 115,926 | 8/1939 | Hopkins | D7/74 |
| D. 153,526 | 4/1949 | Kampa | D7/74 |
| D. 165,894 | 2/1952 | Adler | D7/74 |
| D. 178,993 | 10/1956 | Georgan | D7/74 |
| D. 266,136 | 9/1982 | Peabody | D7/74 |
| 1,937,424 | 11/1933 | Champlin | D7/74 X |
| 2,371,433 | 3/1945 | Davis | D7/74 |
| 2,903,211 | 9/1959 | Weinstock | 248/37.6 |
| 3,187,902 | 6/1965 | Nelson | 211/70.6 |
| 4,561,548 | 12/1985 | Call | 211/70.7 |

OTHER PUBLICATIONS

Washington Forge Advertisement, HFD, Mar. 25, 1985, p. 172.

*Primary Examiner*—Ramon O. Ramirez
*Assistant Examiner*—Robert A. Olson
*Attorney, Agent, or Firm*—Clifford A. Poff

[57] ABSTRACT

A knife stand includes a resting body having a front surface and a top surface, a front piece secured to the front surface, having parallel through slits and having the top thereof higher than the top surface, and a plurality of positioning means each of which is formed on the resting body and capable of positioning thereon the handle of a knife and has a slit corresponding to and communicating with one of the through slits so that one can let the blade of the knife pass through the one through slit and have the end of the handle from which the blade is fixed to the handle positioning in each positioning means and against the rear surface of the top of the front piece.

10 Claims, 6 Drawing Sheets

14,264/6

KNIFE STAND

BACKGROUND OF THE INVENTION

The present invention relates to a stand, and more particularly to a knife stand.

A person working in a kitchen area or a family member always faces the need from time to time to use a knife stand for holding any one of different kinds of knives which are dangerous or hazardous utensils. Conventionally, a knife stand is designed to comprise two spaced bars secured to the wall in the kitchen with the blades of knives extending beneath the spaced bars and the handles of knives suspended on the spaced bars. This design has the following disadvantages:

(1) If a knife stored on the spaced bars is to be used, one needs to pull upwardly the full length of the blade of the knife;

(2) The area on the wall above the place where the spaced bars are secured to the wall must be left free enough in order not to result in any interference or danger upon one's taking knife from the spaced bars; and (3) Normally, the groove between the spaced bars is not divided and therefore one knife will occasionally interfere with one's taking another knife therefrom.

Another prior art known by the Applicant is a protable knife stand having a plurality of grooves capable of receiving therein the knife blades. Nevertheless, the above disadvantages (1) & (2) are not overcome thereby.

It is therefore the object of the invention to obviate the above shortcomings encountered by the prior art.

SUMMARY OF THE INVENTION

It is therefore an object of the present invention to provide a knife stand that one need not pull upwardly the full length of a knife blade in order to take a knife therefrom.

It is another object of the present invention to provide a knife stand capable of being mounted on a crowded wall space in a kitchen.

According to the present invention, a knife stand includes a resting body, a front piece secured to the resting body, having parallel extending first slits and having the top thereof higher than the resting body, and positioning means each of which is formed on the resting body and capable of positioning thereon the handle of a knife and has a second slit corresponding to and communicating with one of the first slits so that one can let the blade of the knife pass first the one through slit and have the end of the handle from which the blade is fixed to the handle positioned one of in the positioning means and against the rear surface of the top of the front piece.

BRIEF DESCRIPTION OF THE DRAWINGS

The present invention may best be understood when the following description is read with reference to the accompanying drawings, in which.

DETAILED DESCRIPTION OF THE PREFERRED EMBODIMENTS

Figure 1:
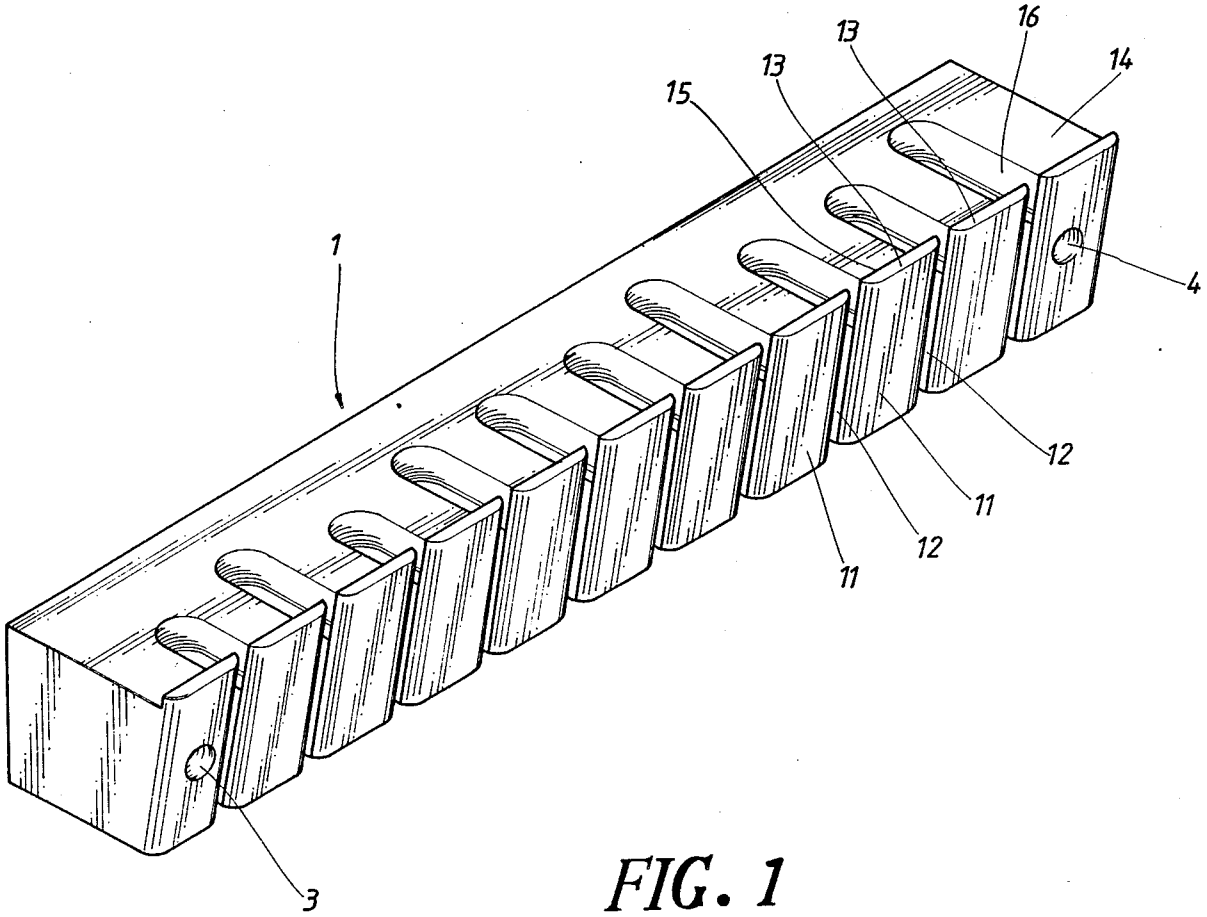
FIG. 1 is a perspective view showing a preferred embodiment of a knife stand according to the present invention.
Figure 2:
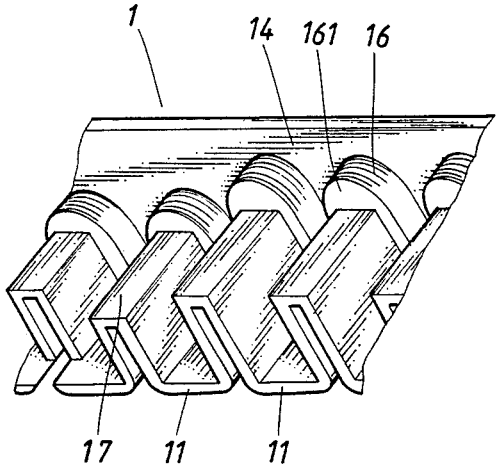
FIG. 2 is a perspective view showing a segment of the resting body of the knife stand in FIG. 1 from the rear side.

Referring now to FIGS. 1 & 2, a knife stand 1 according to the present invention includes a resting body 14 having a front surface and a top surface, a front piece 11 which can be integrally formed to the front surface of body 14, in which a plurality of parallel through slits 12 and has the top 13 is higher by a height H (FIG. 4A) than the top surface of body 14, and a plurality of positioning means each of which is formed on resting body 14 and capable of positioning thereon the handle of a knife and has a slit A (FIGS. 4B & 4C) corresponding to and communicating with one of through slits 12 so that one can let the blade of the knife pass through the one through slit 12 and have the end of the handle from which the blade is fixed to the handle positioned in the corresponding positioning means and against the rear surface 15 of the top 13. Each of the positioning means can include a receiving room 16 having a bottom 161 on which the above slit A is provided. For better positioning the knife on the present stand, each positioning means can further include a blade limiting frame 17 capable of limiting therein a portion of the blade and communicating with the corresponding through slit 12 on front piece 12 and slit A on bottom 161.

Figure 3:
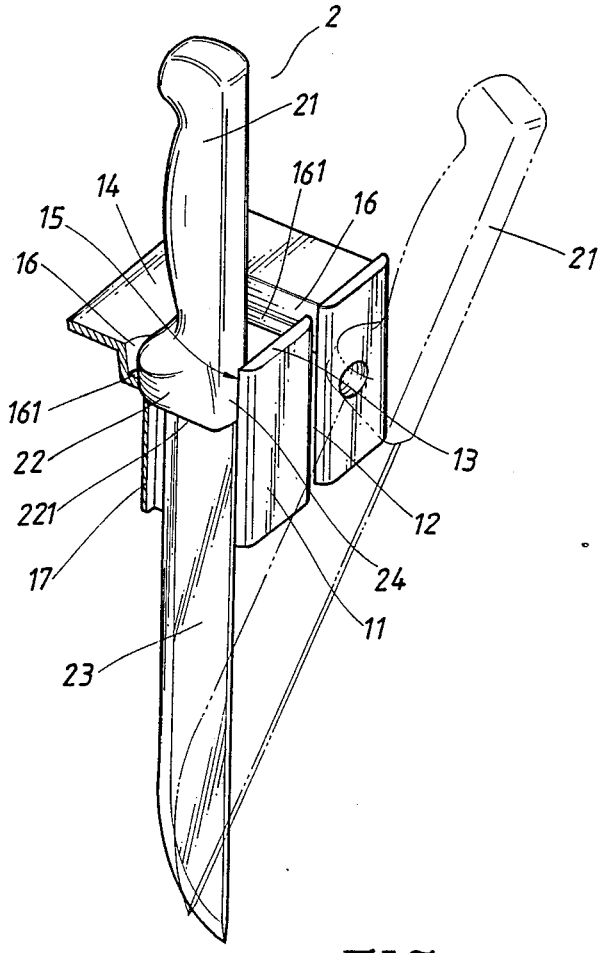
FIG. 3 is a schematic view showing a knife stored in a knife stand according to the present invention.
Figure 4C:
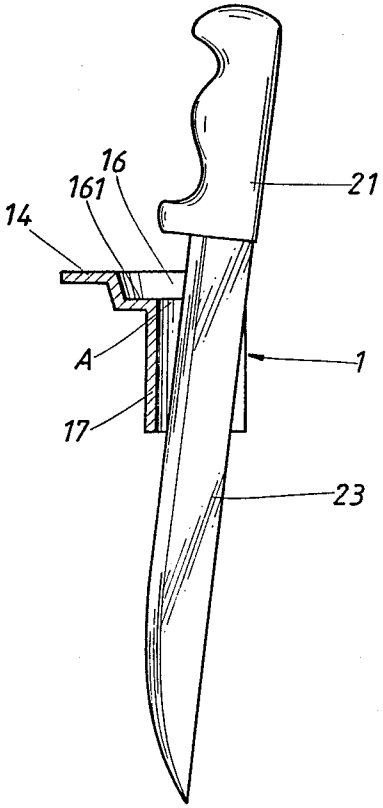
FIGS. 4A–4C are schematic views showing the procedures a knife takes when taken from a knife stand according to the present invention.
Figure 4B:
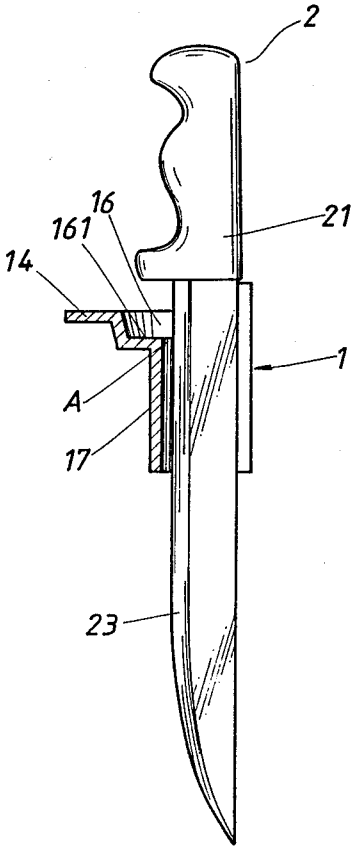
Figure 4A:
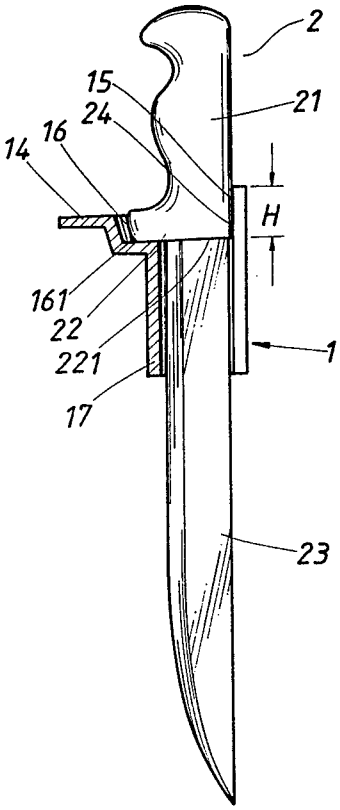

Referring now to FIGS. 3–4C, when a knife 2 is stored in the stand 1, the end 22 of the handle 21 from which the blade 23 is fixed to handle 21 is positioned in a receiving room 16 and the back 24 of end 22 is against the rear surface 15. When knife 2 is to be fetched from the stand 1, handle 21 is raised up only by a height H and then one can immediately get knife 2 by letting blade 23 pass through through slit 12. When knife 2 is to be replaced in stand 1, a knife 2 can automatically drop down to have end surface 221 of end 22 matched against bottom 161 after one has let end 22 pass over top 13.

Figure 5:
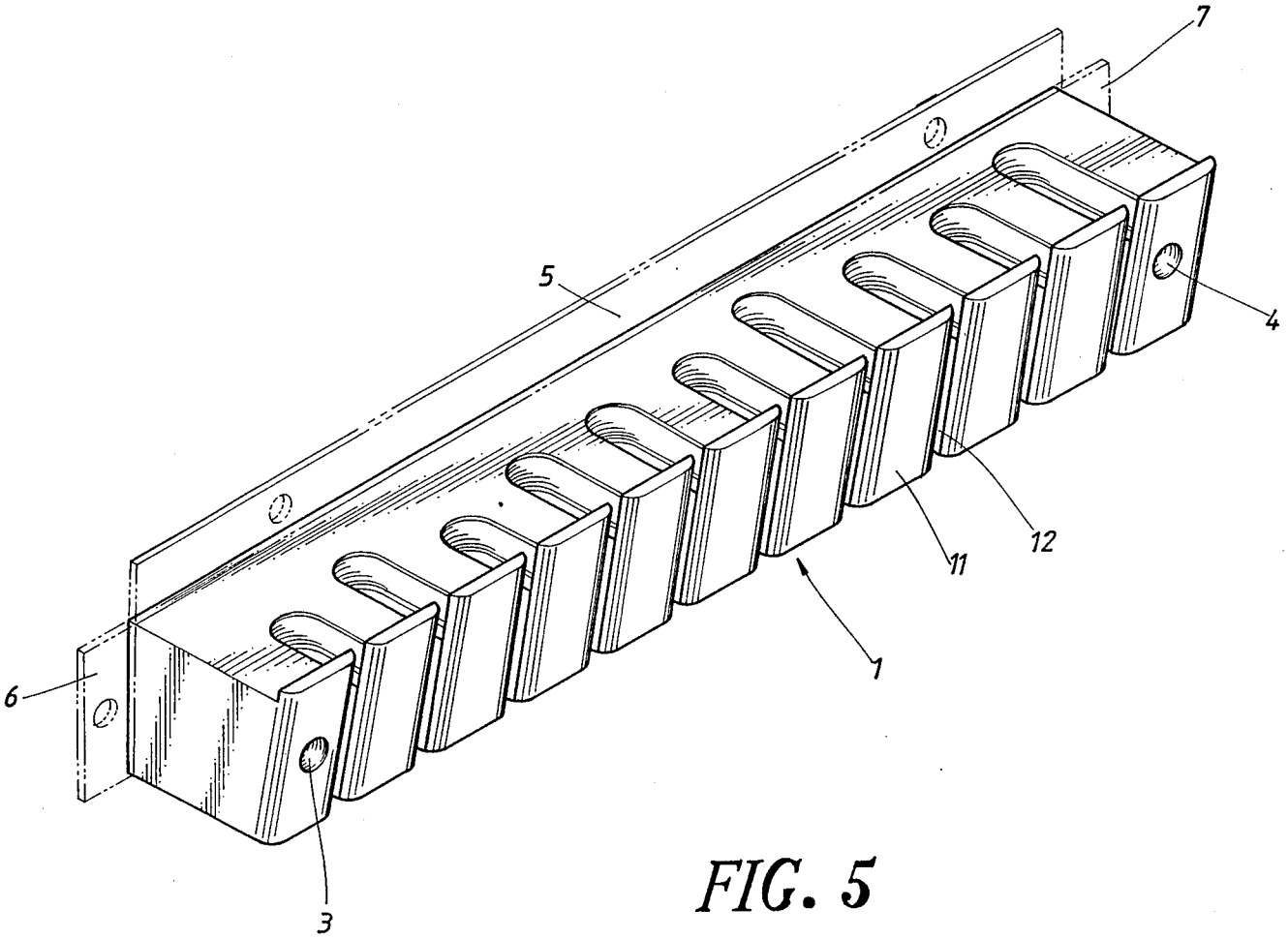
FIG. 5 is a schematic view showing how a knife stand according to the present invention can be secured to a wall in a kitchen.

As shown in FIG. 5, stand 1 itself can be provided with securing holes 3, 4. Alternatively, stand 1 can be provided with mounting extensions 5, 6, 7. As is well known and as a further alternative, the rear surface of stand 1 can be provided with a self-attaching medium, e.g. a Velcro tape.

Figure 7:
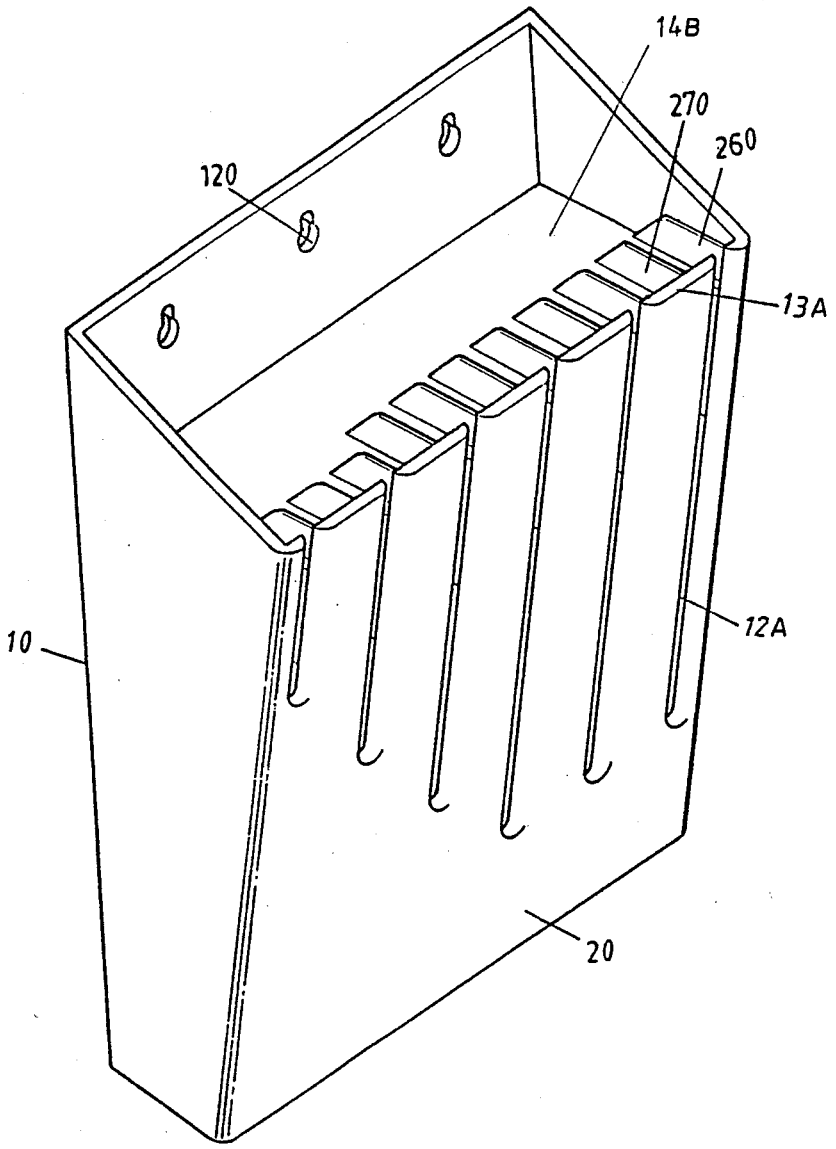
FIG. 7 is a perspective view of still another embodiment of the present invention.

Alternatively, the receiving room 16 can be constituted by two retaining pieces 260, 270 as shown in FIG. 7 positioning therebetween and therein end 22.

Figure 6:
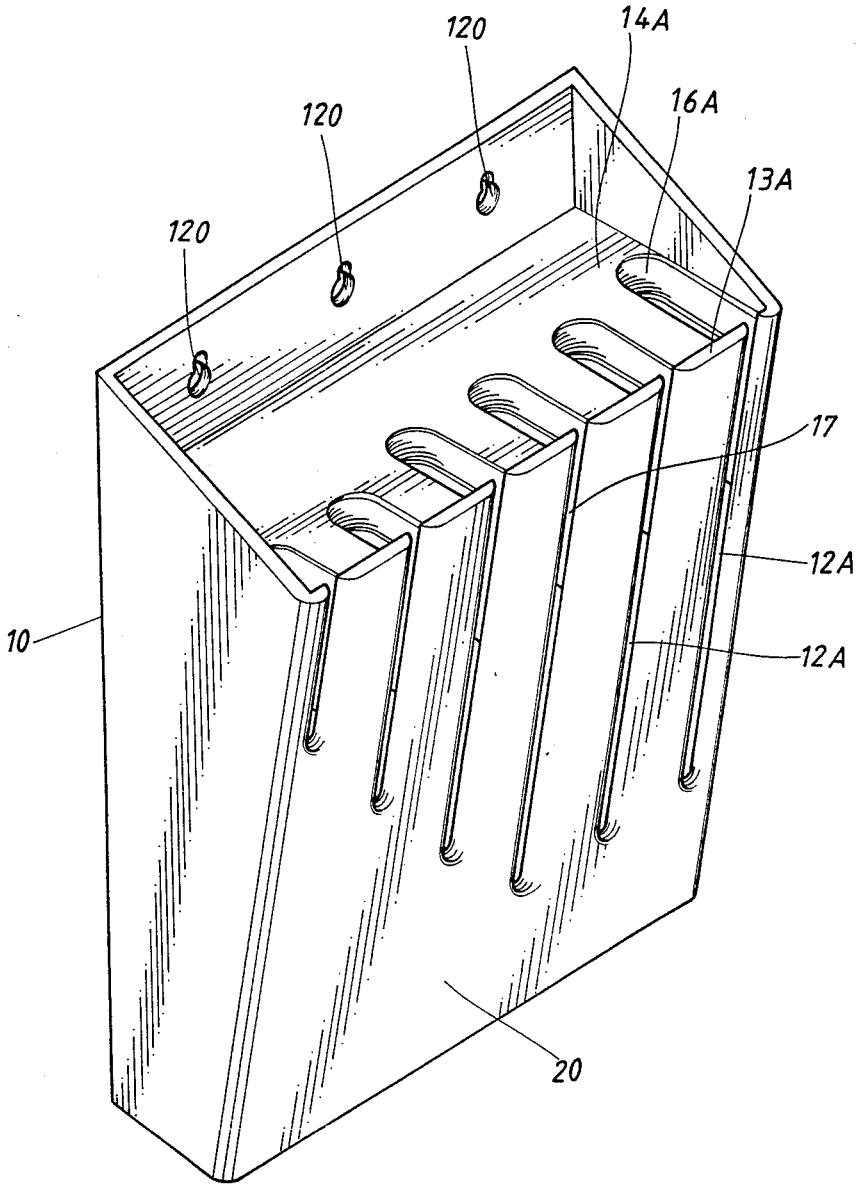
FIG. 6 is a perspective view showing another preferred embodiment of a knife stand according to the present invention.

Referring now to FIGS. 6 & 7, a second preferred embodiment of a knife stand 1 according to the present invention, in which like numerals denote like elements, includes a substantially closed housing having a rear 10 and a front 20 having parallel through slits 12, a resting body 14 received in the housing and having a top surface lower than top 13 of front 20, and a plurality of positioning means each of which is formed in body 14 and is the same as that described in the preceding embodiment. Front 20 can be downwardly inclined toward rear 10 and the length of each through slit 12 can be slightly shorter than that of the blade of a knife to be positioned on the corresponding positioning means. The top of rear 10 can be provided with a plurality of hanging holes 120 for enabling stand 1 to be hung on a desired place.

When knife 2 is stored in the stand 1, blade 23 is entirely contained in the housing and end 22 is well positioned by receiving room 16 and rear surface 15 as in the first embodiment. Since blade 23 is always longer than through slit 12 it passes, the bottom end thereof will contact against the rear surface of front 20' below the respective through slit 12.

Without hanging holes 120, the present stand 1 can still be operative by placing rear 10 against a table. Furthermore, the provision of inclined front 20 on stand 1 will facilitate one's taking knife 2 therefrom.

What I claim is:

1. In combination, a stand including several knives in a secured upright position, said knives having their cutting edges in unexposed positions, each said knife has a knife handle having a front portion and an opposite positioning portion, and said stand comprising:

a support body having a front surface and a top surface;

means forming a front piece on the front surface of said support body for presenting a top edge of the front piece spaced above the top surface of said support body and an exposed restraining inside surface, said front piece having a plurality of spaced apart vertical slits extending downwardly from the top edge toward a bottom edge thereof to permit passage of only a knife blade portion into and out of each slit;

positioning walls depending from said top surface to a floor wall at each of said spaced apart slits along the support body to form handle pockets, each having a receiving portion complementary to said positioning portion of a handle portion of a knife, wherein said complementary portions insure that the cutting edge of a knife will assume said unexposed position, and a blade confining frame depending from the floor wall of each of the said handle pockets; each blade confining frame and the walls forming the handle pocket thereabove having an access opening for a knife blade aligned with a slit in the front piece to receive and confine said front portion of a knife handle against said inside surface of said front piece, and confine a blade portion extending therefrom.

2. The knife stand according to claim 1 wherein said positioning walls include two spaced apart retaining pieces defining a handle pocket therebetween.

3. The stand according to claim 1, wherein said positioning walls are contiguous and said blade confining frame has portions extending in a parallel direction sufficient in length to assist in maintaining a knive in an upright position.

4. The stand according to claim 1, wherein said handle pocket includes a back surface for constraining a handle between said back surface and said inside surface.

5. The stand according to claim 1, wherein said front piece is arranged to extend above said upper portion of said positioning walls.

6. The knife stand according to claim 1 wherein said support body includes a substantially closed housing having a rear wall and a front comprising said front piece.

7. The knife stand according to claim 6 wherein the slits in said front piece have lengths extending from the top edge of the front piece which are shorter than the length of the blade of a knife to be supported in handle pockets associated therewith.

8. The knife stand according to claim 1 wherein said knife stand further includes means for allowing attachment to a support wall.

9. The knife stand according to claim 8 wherein said means includes a rear wall having an opening for receiving fasteners.

10. In combination, a stand including several knives in a secured upright position, said knives having their cutting edges in unexposed positions, each said knife having a knife handle having a front portion and an opposite positioning portion, said stand comprising:

a support body having a front surface and a top surface;

means forming a front piece on the front surface of said support body for presenting a top edge of the front piece spaced above the top surface of said support body, said front piece having a plurality of spaced apart vertical slits extending downwardly from the top edge toward a bottom edge thereof to permit passage of only a knife blade portion into and out of each slit;

positioning walls depending from said top surface to a floor wall at each of spaced apart slits along the support body to form handle pockets, each having a receiving portion complementary to said positioning portion of a handle portion of a knife, wherein said complementary portions insure that the cutting edge of a knife will assume said unexposed position, and said positioning walls including two spaced apart parallel retaining pieces arranged co-extensive of an adjacent slit along said floor wall defining a handle pocket;

a blade confining frame depending from the floor wall of each of the said handle pockets; each blade confining frame and the walls forming the handle pocket thereabove having an access opening for a knife blade aligned with said slit in the front piece to receive and confine said front portion of a knife handle against an inside surface of said front piece, and confine a blade portion extending therefrom.

* * * * *